US007147000B1

(12) United States Patent
Chen et al.

(10) Patent No.: US 7,147,000 B1
(45) Date of Patent: Dec. 12, 2006

(54) COVERING DEVICE FOR DRAIN

(76) Inventors: Ander Chen, No. 392, Section 6, Chang Lu Road Chang Hua Hsien, Fu Hsing Hsiang (TW); Hsing-Rong Hung, 13F-1, No. 1, Section 1, Hsin Hai Road, Taipei City (TW); Hao-Lun Hung, 13F-1, No. 1, Section 1, Hsin Hai Road, Taipei City (TW) 10089

( * ) Notice: Subject to any disclaimer, the term of this patent is extended or adjusted under 35 U.S.C. 154(b) by 0 days.

(21) Appl. No.: 11/161,104

(22) Filed: Jul. 22, 2005

(51) Int. Cl.
*F16I 5/00* (2006.01)

(52) U.S. Cl. ..... 137/362; 251/208; 251/210; 251/212

(58) Field of Classification Search ..... 251/208, 251/210, 212; 137/362
See application file for complete search history.

(56) References Cited

U.S. PATENT DOCUMENTS 1,190,643 A * 7/1916 Harris ..... 220/3.8
3,334,861 A * 8/1967 Westbrook ..... 251/208
4,035,297 A * 7/1977 Aldridge et al. ..... 210/163
5,323,804 A * 6/1994 Lin ..... 137/362
5,746,415 A * 5/1998 Shimizu ..... 251/208
6,283,442 B1 * 9/2001 Whiteside ..... 251/118
6,314,590 B1 * 11/2001 Lee ..... 4/286

OTHER PUBLICATIONS

Taiwan Patent Publication No. 416451, Dec. 21, 2000, 4 pages.

* cited by examiner

*Primary Examiner*—A. Michael Chambers
(74) *Attorney, Agent, or Firm*—Alan D. Kamrath; Nikolai & Mersereau, P.A.

(57) ABSTRACT

A covering device for a drain includes a first cover and a second cover. The first cover defines a plurality of openings. The second cover defines a plurality of openings corresponding to the openings of the first cover. The second cover is rotationally connected to the first cover. In a position, the openings of the second cover are aligned with the openings of the first cover in order to open the drain. In another position, the first cover blocks the openings of the second cover while the second cover blocks the openings of the first cover in order to close the drain.

15 Claims, 12 Drawing Sheets

COVERING DEVICE FOR DRAIN

BACKGROUND OF INVENTION

1. Field of Invention

The present invention relates to a drain and, more particularly, to a covering device for a drain.

2. Related Prior Art

Referring to Taiwanese Patent Publication No. 416451, there is disclosed a cover for a drain. A sink 3 includes a bowl-shaped portion 6 defining a drain 4 and an annular recess 5 around the drain 4. Various covering devices 2, 7, 8 and 9 can be put in the annular recess 5 in order to cover the drain 4. However, none of the covering devices 2, 7, 8 and 9 can completely close the drain. Hence, bugs such as cockroaches can come out of the drain 4 and contaminate food and housewares. Odor can come out of the drain 4 and trouble people.

The present invention is therefore intended to obviate or at least alleviate the problems encountered in the prior art.

SUMMARY OF INVENTION

According to the present invention, a covering device for a drain includes a first cover and a second cover. The first cover defines a plurality of openings. The second cover defines a plurality of openings corresponding to the openings of the first cover. The second cover is rotationally connected to the first cover. In a position, the openings of the second cover are aligned with the openings of the first cover in order to open the drain. In another position, the first cover blocks the openings of the second cover while the second cover blocks the openings of the first cover in order to close the drain.

The primary advantage of the covering device according to the present invention is the ability to close the drain in order to prevent bugs and odor from coming out of the drain.

Other advantages and novel features of the invention will become more apparent from the following detailed description in conjunction with the drawings.

BRIEF DESCRIPTION OF DRAWINGS

The present invention will be described through detailed description of three embodiments referring to the drawings.

DETAILED DESCRIPTION OF EMBODIMENTS

Figure 1:
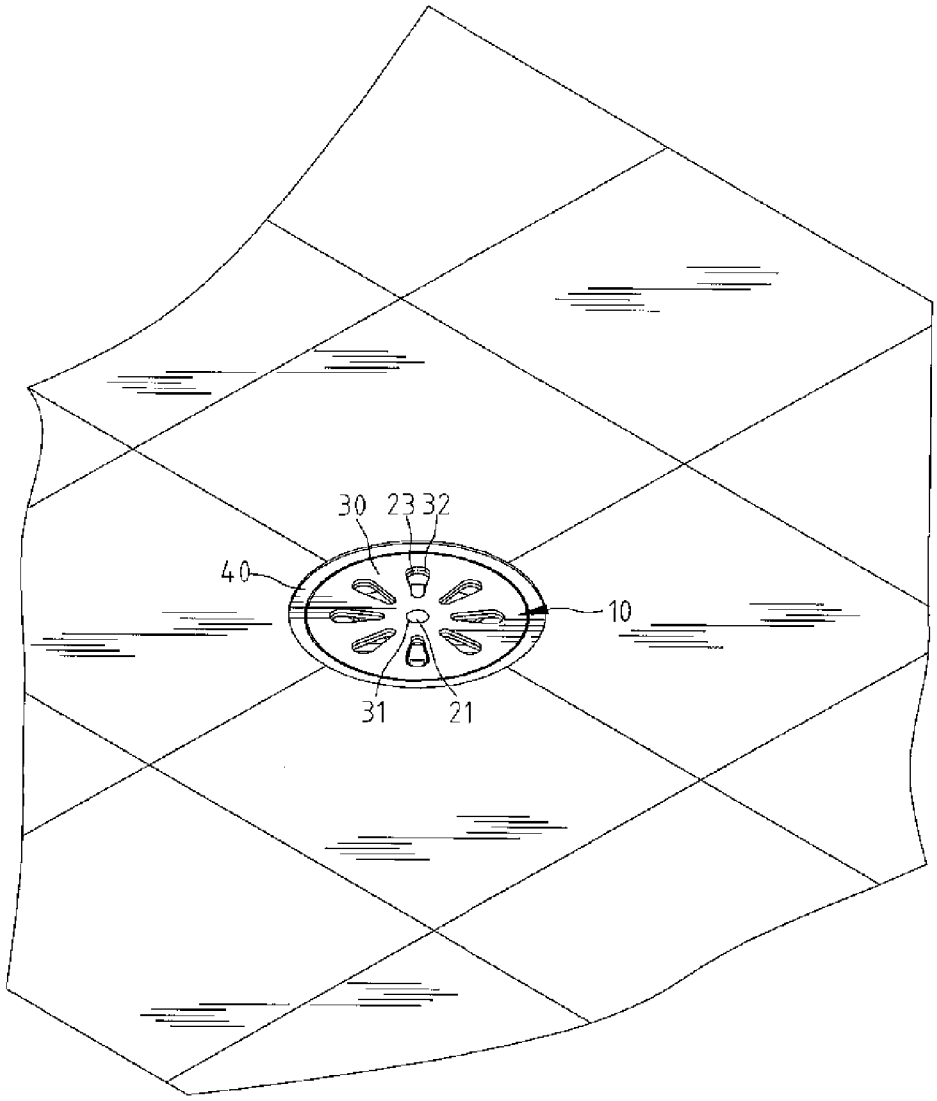
FIG. 1 is a perspective view of a covering device for a drain according to the first embodiment of the present invention.

Referring to FIG. 1, there is shown a covering device 10 for a drain according to a first embodiment of the present invention. A cage 40 is fit in the drain. The covering device 10 is put on the cage 40.

Figure 2:
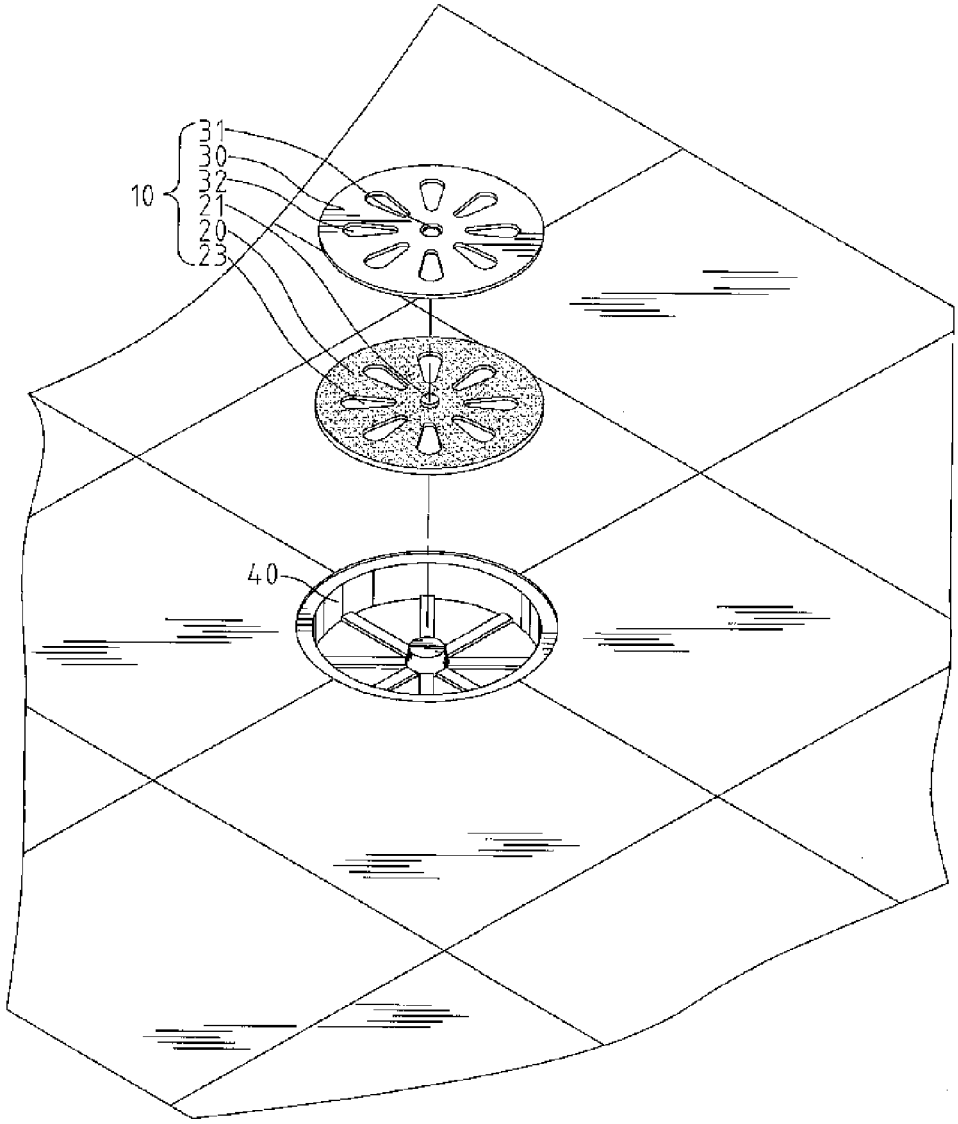
FIG. 2 is an exploded view of the covering device of FIG. 1.

Referring to FIG. 2, the covering device 10 includes a first cover 20 and a second cover 30 rotationally connected to the first cover 20.

Figure 3:
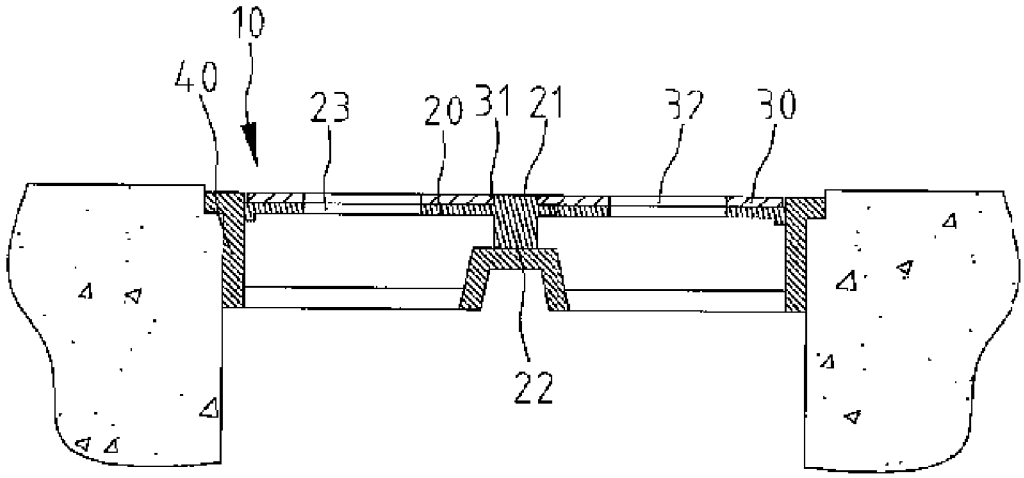
FIG. 3 is a cross-sectional view of the covering device of FIG. 1 ready for opening the drain.

The first cover 20 includes an axle 21 formed on a side and a rod 22 formed on an opposite side. Referring to FIG. 3, the axle 21 includes a mushroom-shaped form. As the covering device 10 is put in the cage 40, the rod 22 is put against the cage 40. The first cover 20 defines a plurality of openings 23 in the form of a teardrop.

The second cover 30 defines an aperture 31 for receiving the axle 21 and a plurality of openings 32 corresponding to the openings 23. The axle 21 is forced through the aperture 31 in order to keep the second cover 30 to the first cover 20 because of the mushroom-shaped form.

Figure 4:
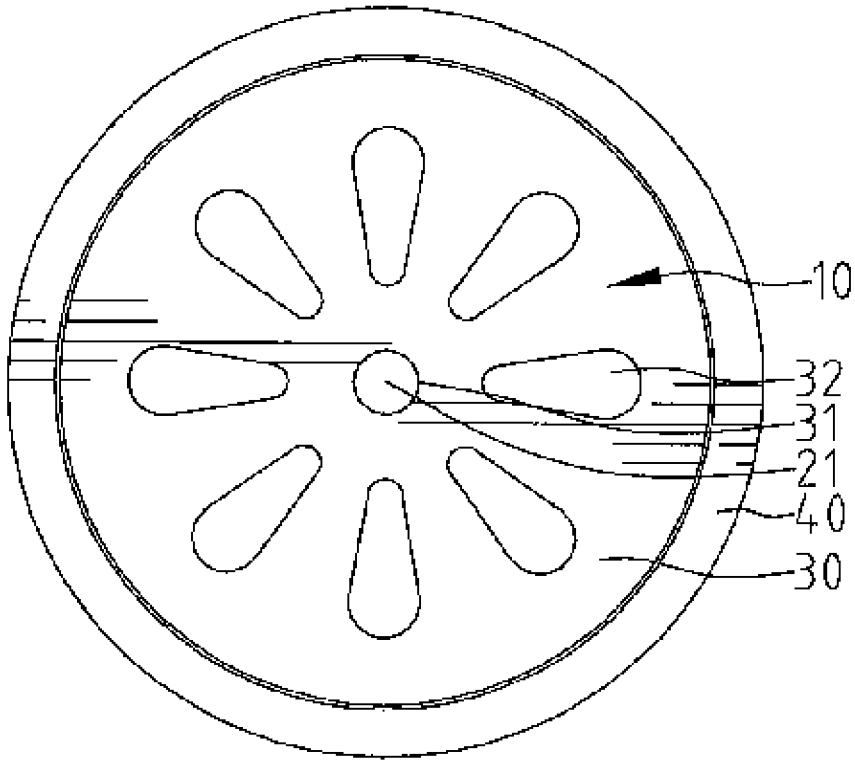
FIG. 4 is a top view of the covering device of FIG. 3.

Referring to FIGS. 3 and 4, the openings 32 are aligned with the openings 23, i.e., the covering device 10 opens the drain. Now, water can flow through the covering device 10.

Figure 5:
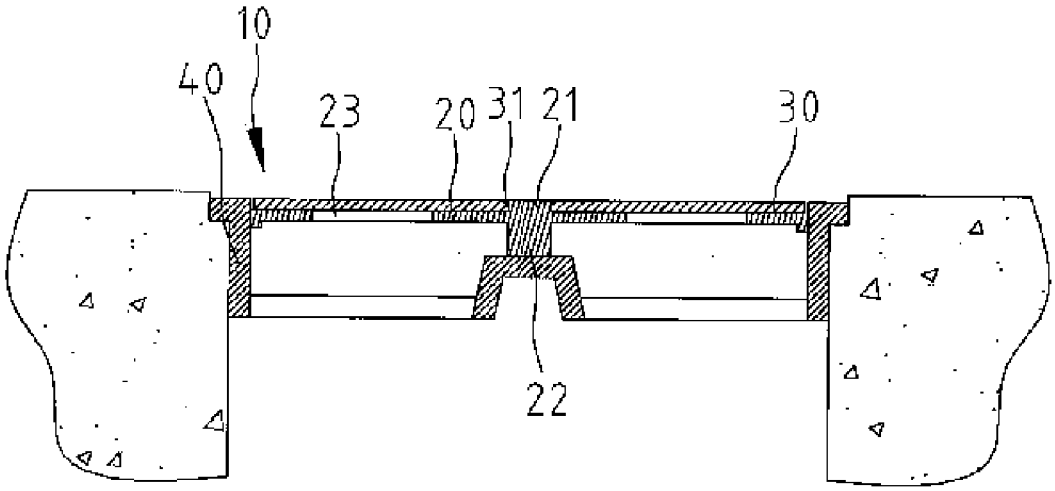
FIG. 5 is a cross-sectional view of the covering device of FIG. 1 ready for closing the drain.
Figure 6:
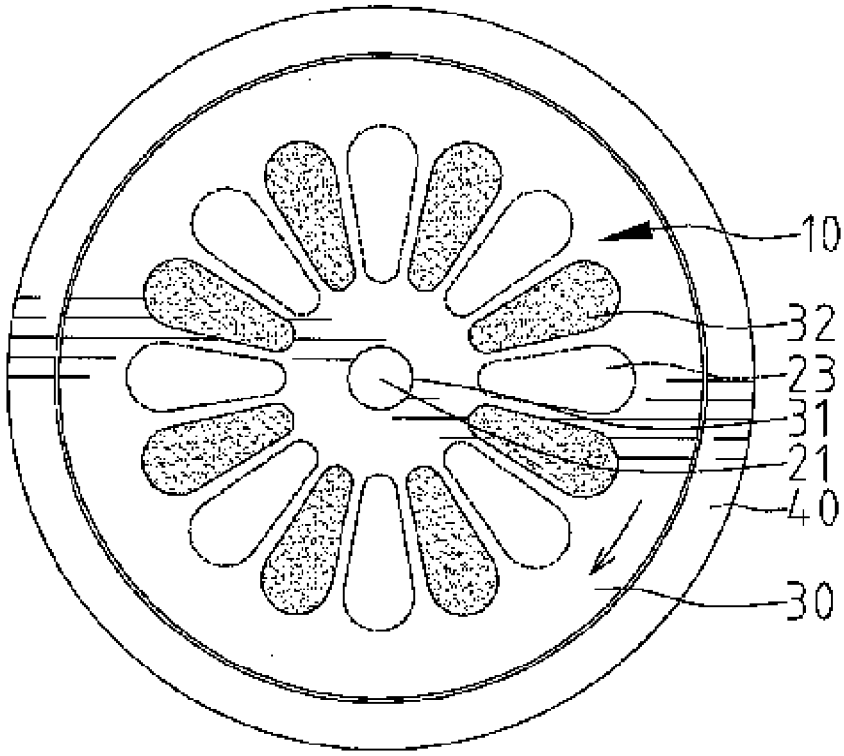
FIG. 6 is a top view of the covering device of FIG. 5.

Referring to FIGS. 5 and 6, the openings 32 are closed by the first cover 20 and the openings 23 are closed by the second cover 30, i.e., the cover device 10 closes the drain. Now, bugs cannot go through the covering device 10 and contaminate food and housewares. Neither can odor go through the covering device 10 and bother people.

Figure 7:
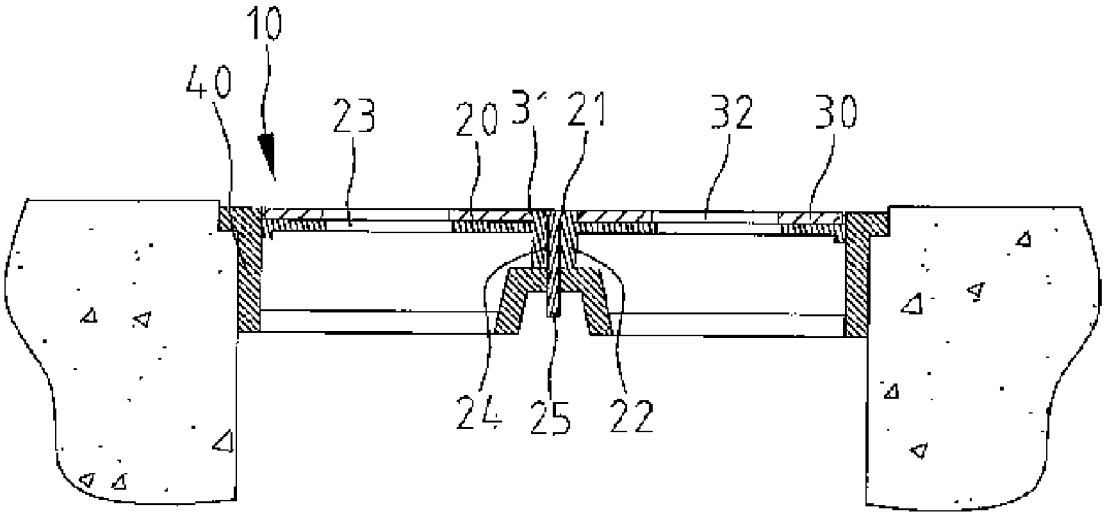
FIG. 7 is a cross-sectional view of a covering device for a drain according to the second embodiment of the present invention.
Figure 8:
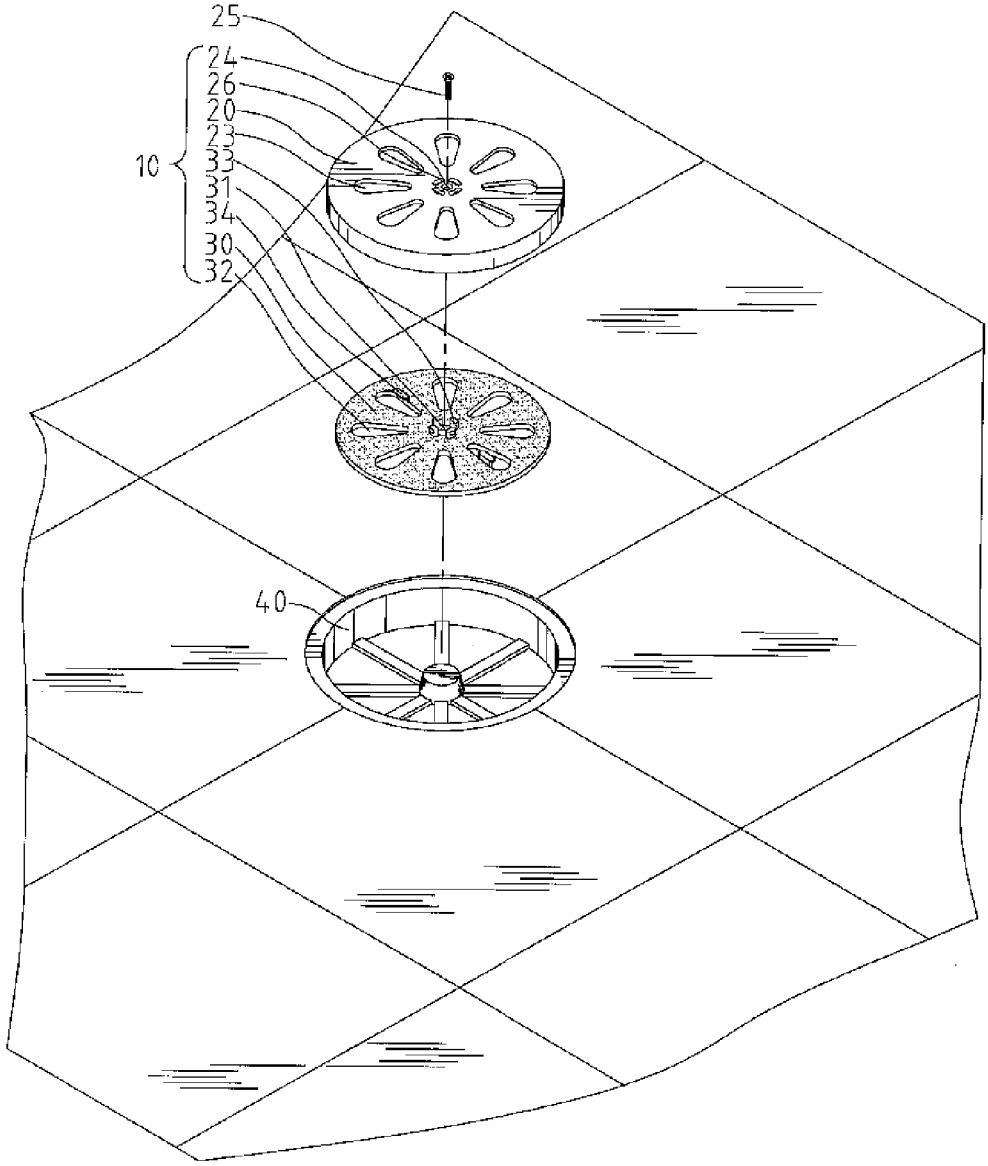
FIG. 8 is an exploded view of a covering device for a drain according to the third embodiment of the present invention.

FIG. 7 shows a covering device 10 according to a second embodiment of the present invention. The second embodiment is similar to the first embodiment except that an aperture 24 is made through the axle 21 and the rod 22 and that a screw 25 is driven into the cage 40 through the aperture 24. Thus, the covering device 10 is connected to the cage 40.

Referring to FIGS. 8 through 12, there is shown a covering device 10 according to a third embodiment of the present invention. The third embodiment is similar to the second embodiment except for a few points. Firstly, the second cover 30 is put beneath the first cover 20. Secondly, the axle 21 and the rod 22 are saved. Thirdly, a plurality of slots 26 is defined in the first cover 20 around the aperture 24. Fourthly, a plurality of hooks 33 is formed on the second cover 30. The hooks 33 are forced through the slots 26 in order to hook the first cover 20. Fifthly, a tab 34 is formed on the second cover 30. The tab 34 is exposed through one of the openings 23 and operable in order to pivot the second cover 30 relative to the first cover 20.

Figure 9:
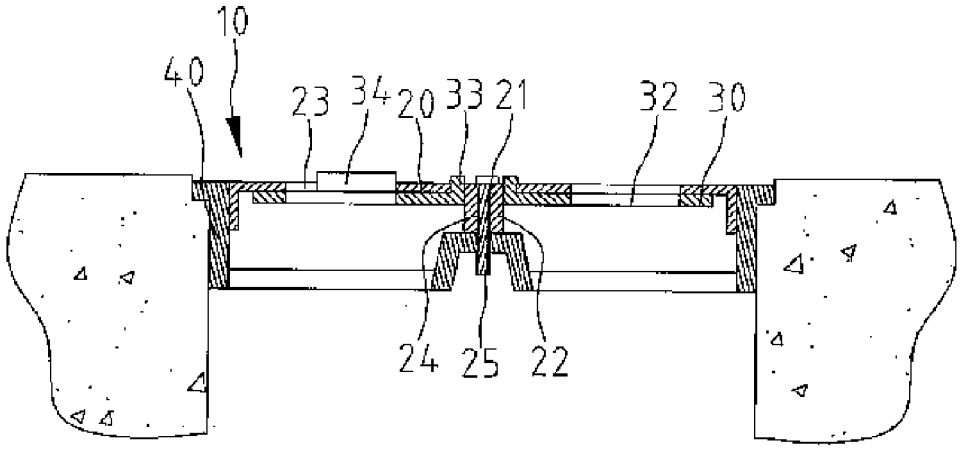
FIG. 9 is a cross-sectional view of the covering device of FIG. 8 ready for opening the drain.
Figure 10:
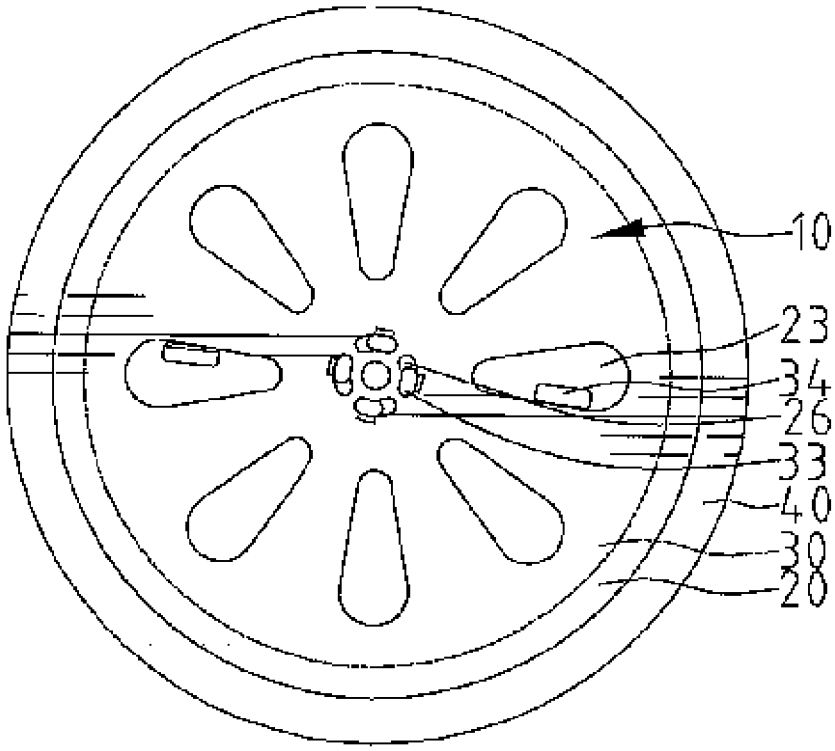
FIG. 10 is a top view of the covering device of FIG. 9.

Referring to FIGS. 9 and 10, the openings 32 are aligned with the openings 23, i.e., the covering device 10 opens the drain. Now, water can flow through the covering device 10.

Figure 11:
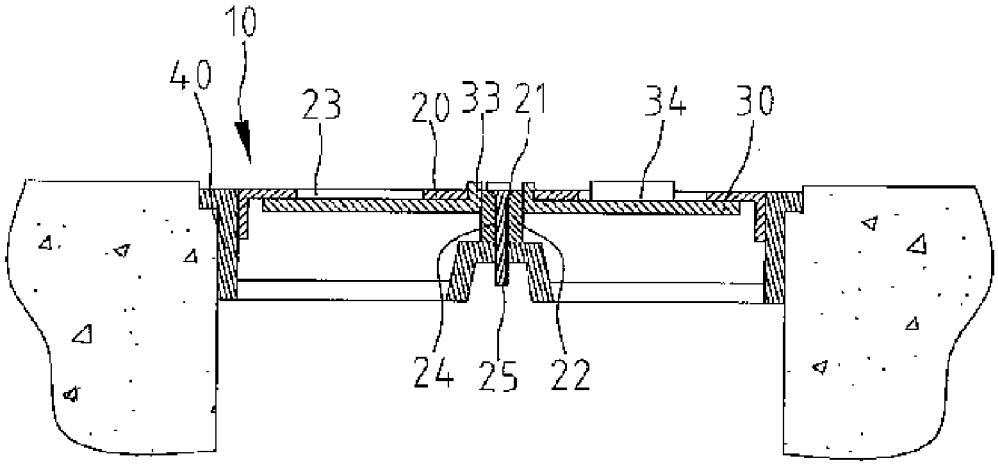
FIG. 11 is a cross-sectional view of the covering device of FIG. 8 ready for closing the drain.
Figure 12:
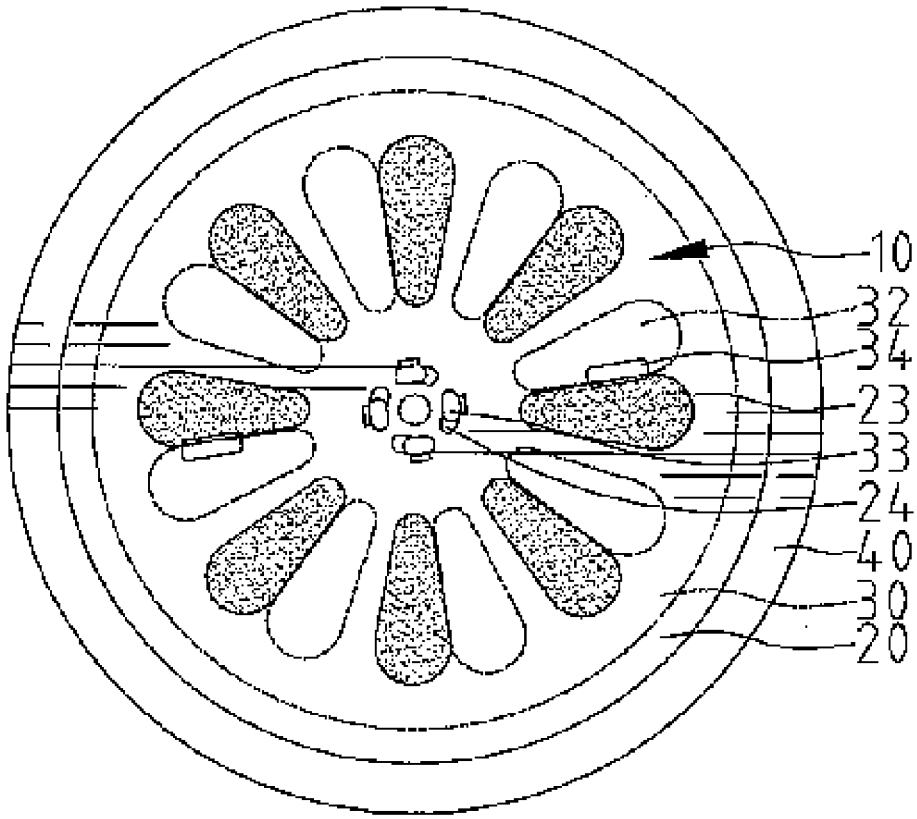
FIG. 12 is a top view of the covering device of FIG. 11.

Referring to FIGS. 11 and 12, the openings 32 are closed by the first cover 20 and the openings 23 are closed by the second cover 30, i.e., the cover device 10 closes the drain. Now, bugs cannot go through the covering device 10 and contaminate food and housewares. Neither can odor go through the covering device 10 and bother people.

The present invention has been described through the detailed description of the embodiments. Those skilled in the art can derive variations from the embodiments without departing from the scope of the present invention. Therefore, the embodiments shall not limit the scope of the present invention defined in the claims.

What is claimed is:

1. A covering device for a drain, the covering device comprising a first cover defining a plurality of openings and a second cover defining a plurality of openings corresponding to the openings of the first cover, wherein the second cover is rotationally connected to the first cover so that the openings of the second cover can be aligned with the openings of the first cover in order to open the drain and that the first cover can block the openings of the second cover while the second cover blocks the openings of the first cover in order to close the drain.

2. The covering device according to claim 1 wherein the first cover comprises an axle formed thereon, wherein the second cover comprises an aperture defined therein for receiving the axle.

3. The covering device according to claim 2 wherein the axle comprises a mushroom-shaped form for keeping the second cover to the first cover.

4. The covering device according to claim 2 comprising a screw driven into a cage put securely in the drain through the first and second covers.

5. The covering device according to claim 4 wherein the axle defines an aperture for receiving the screw.

6. The covering device according to claim 1 comprising a screw driven into a cage put securely in the drain through the first and second covers.

7. The covering device according to claim 6 wherein the first cover defines an aperture for receiving the screw.

8. The covering device according to claim 6 wherein the second cover defines an aperture for receiving the screw.

9. The covering device according to claim 1 wherein the first cover comprises a rod formed thereon for abutment against a cage put securely in the drain.

10. The covering device according to claim 1 wherein the first cover comprises a plurality of slots defined therein, wherein the second cover comprises a plurality of hooks formed thereon and forced through the slots in order to hook the first cover.

11. The covering device according to claim 10 wherein the second cover comprises a tab formed thereon and exposed through one of the openings of the first cover and operable in order to rotate the second cover relative to the first cover.

12. The covering device according to claim 10 comprising a screw driven into a cage put securely in the drain through the first and second covers.

13. The covering device according to claim 12 wherein the first cover defines an aperture for receiving the screw.

14. The covering device according to claim 12 wherein the second cover defines an aperture for receiving the screw.

15. The covering device according to claim 1 wherein the openings are in the form a teardrop.

* * * * *